US005364281A

United States Patent [19]

Leto

[11] Patent Number: 5,364,281

[45] Date of Patent: Nov. 15, 1994

[54] ELECTRICAL CONNECTOR SYSTEM FOR GROUNDING MEMBER AND GROUND WIRE

[75] Inventor: Salvadore Leto, Metairie, La.

[73] Assignees: Philly D. Harrison; Paul R. Leto; Francis T. Leto, all of Metairie, La.

[21] Appl. No.: 70,737

[22] Filed: Jun. 1, 1993

[51] Int. Cl.[5] ..... H01R 4/36; H01R 4/66

[52] U.S. Cl. ..... 439/100; 439/797; 403/378

[58] Field of Search ..... 439/100, 797, 798; 285/383, 404; 403/377, 378

[56] References Cited

U.S. PATENT DOCUMENTS

| | | | |
|---|---|---|---|
| 1,590,590 | 6/1926 | Seymour et al. | 439/100 |
| 1,675,163 | 6/1928 | Colburn | 439/100 |
| 1,897,186 | 2/1933 | Buchanan | 439/100 |
| 2,077,613 | 4/1937 | Bondeson | 439/100 |
| 2,482,718 | 9/1949 | Oathout | 403/378 |
| 2,547,932 | 4/1951 | Downs, Jr. | 439/100 |
| 3,058,087 | 10/1962 | Piasecki | 439/100 |
| 3,492,625 | 1/1970 | Bromberg | 439/100 |
| 3,609,631 | 9/1971 | Looney | 439/100 |
| 3,864,013 | 2/1975 | Levy | 439/797 |
| 3,892,455 | 7/1975 | Sotolongo | 439/100 |
| 3,985,411 | 10/1976 | Mooney | 439/100 |
| 3,988,052 | 10/1976 | Monney | 439/804 |
| 4,106,832 | 8/1978 | Burns | 439/100 |
| 4,114,846 | 9/1978 | Peterson | 248/68 |
| 4,159,859 | 7/1979 | Shemtov | 439/100 |
| 4,189,198 | 2/1980 | Reichman | 439/100 |
| 4,210,374 | 7/1980 | Chula | 439/100 |
| 4,248,490 | 2/1981 | Bachle | 439/100 |
| 4,438,954 | 3/1984 | Hattori | 285/404 |
| 4,623,204 | 11/1986 | Auclair | 439/100 |
| 4,626,051 | 12/1986 | Franks, Jr. | 439/100 |
| 4,780,096 | 10/1988 | Franks, Jr. | 439/813 |
| 4,806,108 | 2/1989 | Meinhart | 439/100 |
| 4,828,504 | 5/1989 | Franks, Jr. | 439/92 |
| 4,863,390 | 9/1989 | Cera | 439/100 |
| 4,887,970 | 12/1989 | den Hartog | 439/92 |
| 4,954,084 | 9/1990 | Pugh | 439/29 |
| 4,961,598 | 10/1990 | Sundholm | 285/404 |
| 4,962,285 | 10/1990 | Baker | 174/6 |

*Primary Examiner*—Gary F. Paumen
*Attorney, Agent, or Firm*—C. Emmett Pugh

[57] ABSTRACT

A basic connector body (13) which electrically connects and mechanically secures a ground wire (1) to a grounding member (14), e.g. pipe or electrical conduit, which body is made of a one piece brass alloy casting. The generally cylindrical, basic connector body has a smaller diameter, wire section and a larger diameter, pipe section, the size of the latter allowing the body to be slipped over the pipe end. In contrast, the smaller, wire section prevents the pipe from passing through the connector body due to the presence of a ridge (7). When the connector body is slipped over the end of the grounding pipe until the end of the pipe bears against the ridge, a first set screw (8) is screwed down until it drives itself down against the outer, exterior surface of the pipe, electrically connecting and mechanically securing the connector body to the pipe. Preferably after the connector body is secured to the pipe, the wire is inserted into the interior of the connector body until its end is at least past a wire set screw, threaded opening (4). Once the wire is properly positioned within the interior of the body, a second set screw (5) is screwed down until it contacts and drives itself down against the wire, securing it against the opposed, interior of the wire section, causing it to also be electrically connected and mechanically secured to the body, thereby indirectly electrically connecting and mechanically securing the wire to the pipe, using the two, interiorly protected, set screw connections.

15 Claims, 2 Drawing Sheets

ELECTRICAL CONNECTOR SYSTEM FOR GROUNDING MEMBER AND GROUND WIRE

TECHNICAL FIELD

The present invention relates broadly to electrical connectors for connecting ground wires to grounding pipes, rods or electrical conduit and like grounding members, some of which typically extend down into the ground to electrically "ground" an electrical device of system, and more particularly to a simplified construction of an electrical grounding or terminal clamp for establishing a permanent electrical connection for a device (e.g. electrical conduit, TV antennae, etc.) to, for example, a grounding pipe or cylindrical, hollow grounding structure or solid grounding rod, using a ground wire extending between them. More particularly, the present invention relates to such a grounding clamp in which a generally cylindrical, larger diameter, connecting end piece is placed coaxially over the end of the grounding structure with a substantially coincident longitudinal axis, encircling it, and being connected thereto and over the end of the grounding structure with a simple, laterally or axially directed lug or set screw, while a second, laterally or axially directed lug or set screw is used to connect the generally cylindrical, coaxial end piece to the grounding wire internally within the end piece.

BACKGROUND ART

As may be seen from a review of the below cited patents, the prior art has failed to contemplate a system as taught in the present invention. Further, the patents cited below are fully distinguishable from the invention in construction and use, and indeed some of them are from different arts and not part of the art to which this invention pertains.

| Patent No. | Patentee | Date |
|---|---|---|
| 1,590,590 | Seymour et al | 06/29/26 |
| 1,675,163 | Colburn | 06/26/28 |
| 1,897,186 | Buchanan | 02/14/33 |
| 2,077,613 | Bondeson | 04/20/37 |
| 2,547,932 | Downs, Jr. | 04/10/51 |
| 3,058,087 | Piasecki | 10/09/62 |
| 3,492,625 | Bromberg | 01/27/70 |
| 3,609,631 | Looney | 09/28/71 |
| 3,892,455 | Sotolongo | 07/01/75 |
| 3,985,411 | Mooney et al | 10/12/76 |
| 3,988,052 | Mooney et al | 10/26/76 |
| 4,106,832 | Burns | 08/15/78 |
| 4,114,846 | Petersen | 09/19/78 |
| 4,159,859 | Shemtov | 07/03/79 |
| 4,189,198 | Reichman | 02/19/80 |
| 4,210,374 | Churla | 07/01/80 |
| 4,248,490 | Bachle | 02/03/81 |
| 4,623,204 | Auclair | 11/18/86 |
| 4,626,051 | Franks, Jr. | 12/02/86 |
| 4,780,096 | Franks, Jr. | 10/25/88 |
| 4,806,108 | Meinhardt | 02/21/89 |
| 4,828,504 | Franks, Jr. | 05/09/89 |
| 4,863,390 | Cera et al | 09/05/89 |
| 4,887,970 | den Hartog | 12/19/89 |
| 4,954,084 | Pugh et al | 09/04/90 |
| 4,962,285 | Baker | 10/09/90 |

A cursory review of the above cited patents shows that the prior art is indeed clearly distinguishable from and does not make "obvious" the present invention.

Most of these prior patents are directed to one form or another of a clamping device which either strappingly encircles or straddles the outer body of electrical pipe or conduit at an area removed from the end of the electrical pipe or conduit or encircles or straddles the outer body of the grounding pipe, using typically at least several basic parts, along with one or more connecting screws and nuts or lugs.

Another approach is using a threaded end piece, which is screwed unto the end of the electrical conduit and used as a base for securing a number of relatively complex clamping and attaching elements to the end piece; note, for example, the patents to Bromberg ('625), Shemtov ('859), Reichman ('198), Bachle ('490) and Churia ('374).

Still another approach is using a pipe section having an integral ground wire connecting box or protrusion extending out on one side, in which the somewhat unitary device is used as part of the actual water line connected in-line therewith; see, for example, the patent to Burns ('832).

The Baker patent ('285) is directed to a swimming pool deck anchor of plastic material, in which a plastic end piece having an interior ridge is mounted on the end of a plastic pipe, with a multiple element, electrical grounding connector attached to the exterior of the plastic end piece.

It is believed that a number of other patents directed to water pipe and end pipe ground clamp systems therefor can be found in, for example, Class 439, particularly Subclasses 92 and 100.

GENERAL DISCUSSION OF INVENTION

The present invention is directed to a grounding clamp for a grounding member in which a generally cylindrical, larger diameter, connecting end piece is placed coaxially over the end of the grounding pipe or electrical conduit with a substantially coincident longitudinal axis, encircling it, and being connected thereto and over and past the end of the grounding pipe or conduit with preferably a simple set screw or lug. A second set screw or lug is used to connect the generally cylindrical, coaxial end piece to the grounding wire internally within the end piece and, if so desired, with the ground wire extending into the grounding pipe or conduit. This is all achieved with only one basic connecting piece, all without the need of threading the end piece to the end of the grounding member end and without any other complex, multi-piece attachment structure.

The connector end piece preferably includes a basic, generally cylindrical body having a larger diameter, pipe, end section for fitting over the grounding pipe or conduit and a smaller diameter, wire, end section into which the ground wire is inserted, the latter of which has an inner diameter less than the outer diameter of the grounding pipe, preventing the pipe from completely passing through the connector end piece. Both lugs preferably are in line with one another and form internal, protected or physically shielded connections, mechanically and environmentally protected by the encircling shell formed by the basic, connector body.

Thus, the present invention provides a simplified construction of an electrical grounding clamp, which may be quickly installed for establishing a reliable electric connection for a grounding pipe or electrical conduit.

The present invention provides a construction of an electrical grounding clamp which may be manufactured inexpensively on a mass production scale utilizing a minimum number of parts and insuring a quick and reliable electrical connection with an electrical conductor or grounding wire.

The present invention also provides improved construction of a clamp which may be readily and conveniently fitted to the end of a ground pipe or electrical conduit of one size, for establishing a reliable electrical connection with an electrical conductor which accepts different sizes of wire, but one size of pipe. The fitting can be made larger by increasing the size of the fitting.

Other and further objects of this invention reside in that the connector body is made, for example, of a brass alloy and in one piece instead of consisting of many pieces.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein:

FIG. 4 is a perspective of the embodiment of FIG. 1, showing basically the same structure as FIG. 3, but providing a perspective of what the bottom of the electrical connector looks like.

EXEMPLARY MODE FOR CARRYING OUT THE INVENTION

Figure 1:
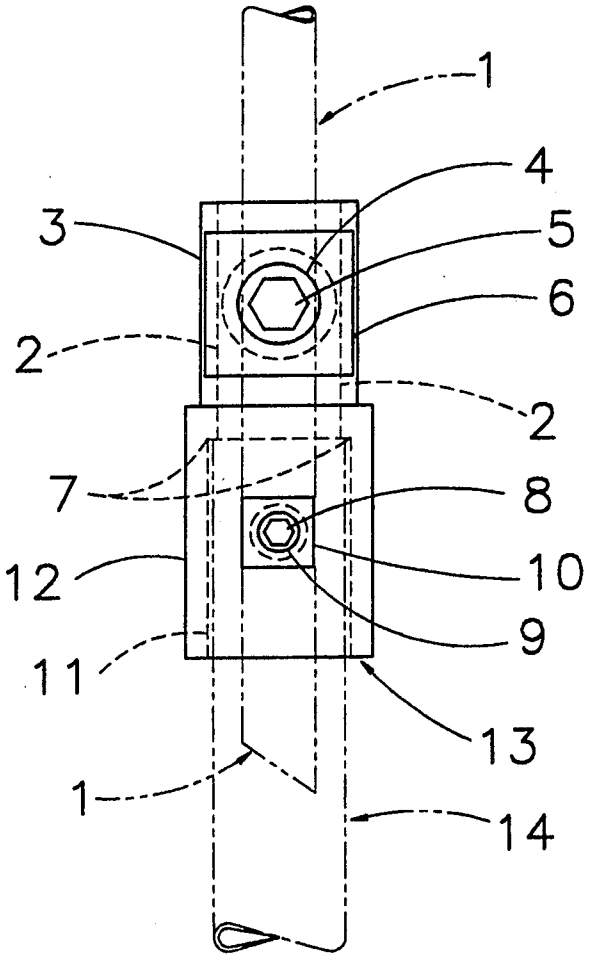
FIG. 1 is a front, side view of an exemplary embodiment of the electrical connector system for connecting a ground wire to a grounding pipe or electrical conduit, showing the basic end connector clamp and the way it fits on the end of a grounding pipe or conduit, and the way the grounding wire fits into the interior of the clamp.
Figure 5:
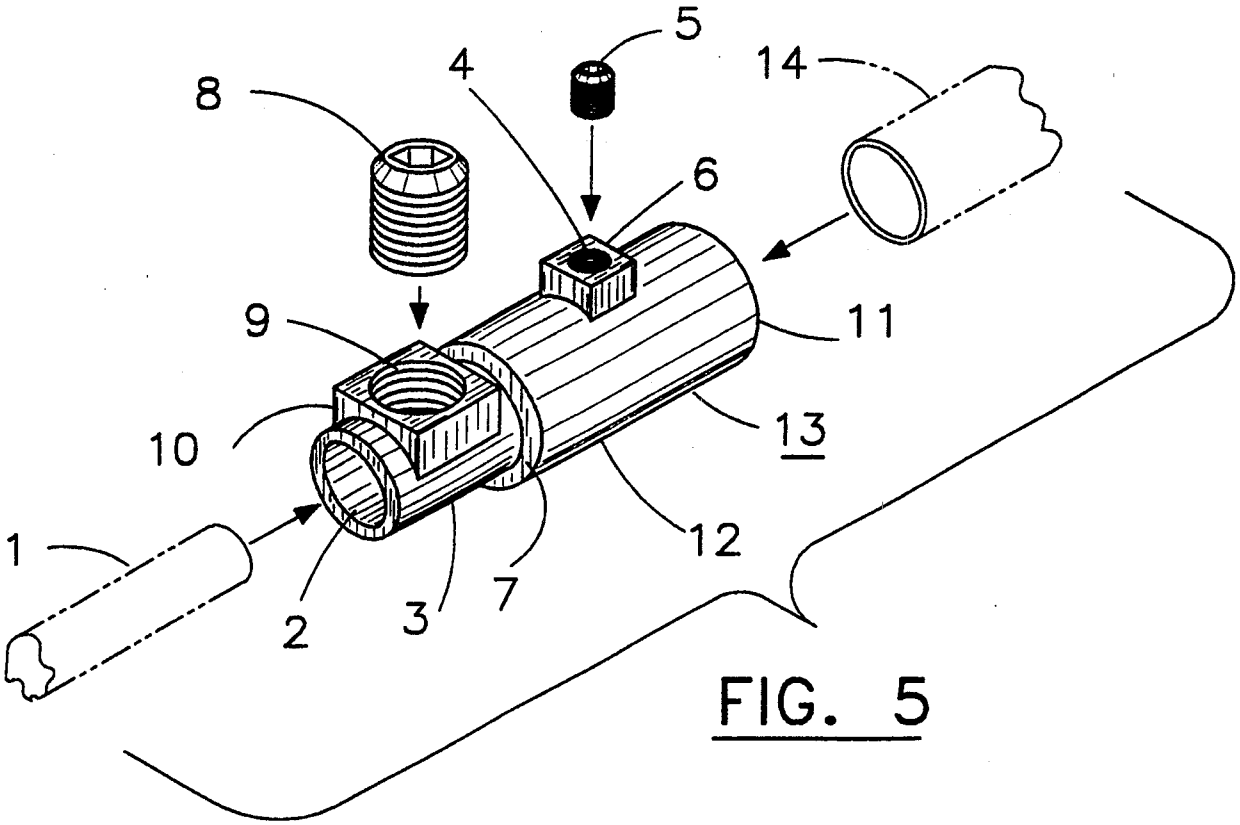
FIG. 5 is a perspective, exploded view of the embodiment of FIG. 1, showing how the parts go together and showing the one piece nature of the connector body.
Figure 3:
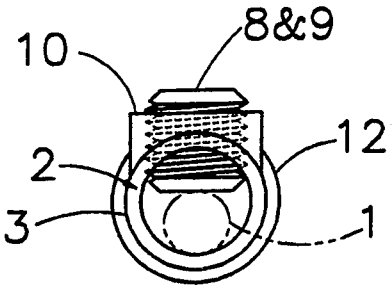
FIG. 3 is top view of the embodiment of FIG. 1, showing how the wire set screw pushes down and clamps the grounding wire in place to ensure a good and reliable electrical connection. This figure also shows how the end of grounding pipe or conduit fits and rests against the stop rim or ridge on the interior of the connector.
Figure 4:
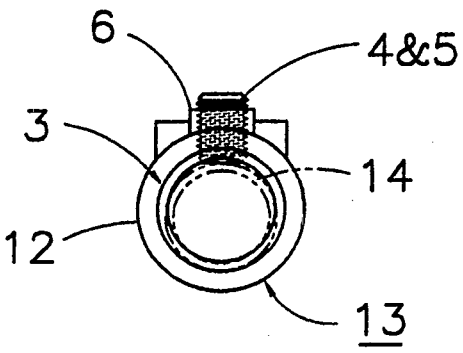

Referring to the drawings in detail and as can be seen, for example, in FIGS. 1 & 5, the exemplary embodiment of the connector system of the present invention includes a basic connector body 13, which electrically connects and mechanically secures the ground wire 1 to the grounding pipe or conduit 14. The connector body 13 is preferably an integral, unitary piece made of, for example, a one piece casting of brass alloy or other strong, electrically conductive material.

The generally cylindrical, basic connector body 13 has a smaller diameter section defined by the inside wall 2 and the outside wall 3 for the wire 1 and a larger diameter section defined by the inside wall 11 and the outside wall 12 for the pipe 14. The larger, pipe section has an inner diameter forming an open, interior chamber defined by the encircling inner wall 11, which is larger than the outer diameter of the grounding pipe 14, allowing it to be slipped over the end of the pipe. In contrast, the smaller, wire section of the body 13 has an inner diameter forming another, open interior chamber defined by the encircling inner wall 2, which is smaller than the outer diameter of the grounding pipe 14, preventing the exposed end of the pipe from passing completely through the connector body.

The difference between the diameters of the coaxial inner walls 2 & 11 creates a flat, laterally or axially extending ridge 7 between the larger, pipe section and the smaller, wire section. The presence of the ridge 7 prevents the grounding pipe 14 and the smaller, wire section of the body from passing one another when the connector body 13 is slipped over the exposed end of the grounding pipe 14.

When the connector body 13 is slipped or slid over the end of the grounding pipe or electrical conduit 14, preferably until the exposed end of the pipe or conduit bears against the ridge 7, a laterally or axially directed, set screw or lug 8 for the pipe working in the threaded orifice or hole 9 is screwed down until its interior tip contacts and drives itself down against the outer surface of the grounding pipe 14. This electrically connects and mechanically secures the connector body 13 to the grounding pipe 14. This connection is particularly secure when the ridge 7 of the connector body is in face-to-face contact with the end of the pipe 14, that is, when the former rides on the latter, preventing any tendency for the body to wobble about the end of the pipe under laterally directed force, which would otherwise ultimately cause the grip of the body on the pipe to become loose.

Figure 2:
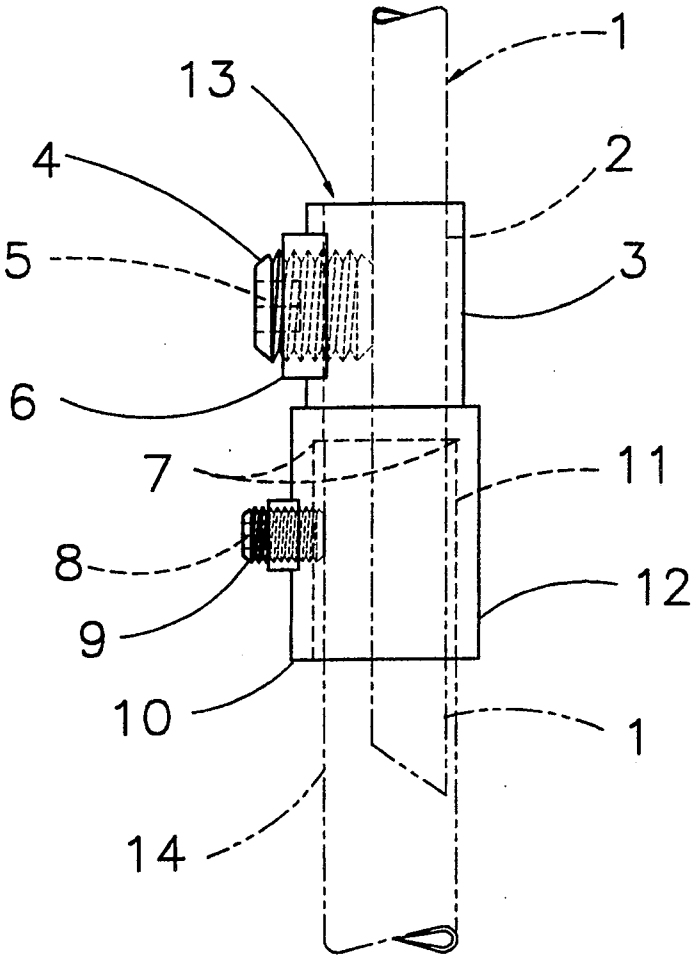
FIG. 2 is another side view of the embodiment of FIG. 1 but rotated ninety (90) degrees from the perspective of FIG. 1, showing in phantom line the way the set screws or lugs electrically and mechanically secure the grounding pipe and grounding wire together.

Prior to or preferably after the connector body is placed on and secured to the pipe, the ground wire 1 is longitudinally inserted into the interior of the connector body 13 until its end is at least past the set screw opening or threaded hole 4. If so desired, the end of the wire 1 can be extended down well into the interior of both the connector body and the grounding pipe 14, as illustrated in FIGS. 1 & 2. Once the wire 1 is properly positioned within the interior of the body 13, wire set screw 5 is screwed down until its interior tip contacts and drives itself down against the wire securing it to and against the interior of the smaller wire section of the body, causing it to also be electrically connected and mechanically secured to the body. This then indirectly electrically connects and mechanically secures the ground wire 1 to the grounding pipe 14 with two shielded or protected connections shielded from the environment.

As noted, the ground wire 1 is inserted down into the middle or open interiors of the connector body and pipe, but if a solid grounding rod is used, the wire is preferably cut to length so that at least one (1") inch of bare wire is located within in the connector body 13.

Structurally beefed up or thickened areas 6 & 10 preferably are provided in the body 13 for the set screws 5 & 8, respectively, with the set screw areas preferably being located on the same side along the same longitudinal line as can best be seen in the side view of FIG. 1. The set screws 5 & 8 are standard, off-the-shelf items made of electrically conductive material and can be, for example, one-half (½) inch size and quarter (¼") inch size, respectively. The set screws 5 & 8 preferably each include laterally or axially directed, allen wrench holes or orifices (see FIG. 1) for tightening and loosening them using the driving force of an allen wench.

With this design, the connector body 13 can be quickly and easily used to electrically connect and mechanically secure the ground wire 1 to the grounding pipe 14. The set screw connections both occur in the interior of the body 13, protecting and shielding the connections from being mechanically hit and covering them from corrosion or at least diminishing the exposure of the connections to the elements. For further protection the open end of the connector into which the wire 1 is inserted could be plugged closed with suitable material, if so desired.

The walls of the larger and smaller sections of the connector body 13 can be, for example, each an eighth (⅛") of an inch thick. The larger section can have an inner or inside diameter of, for example, three-quarters (¾") of an inch, which would accept a grounding pipe or rod of the same or smaller size. The outer diameter of the larger, pipe section can be, for example, one (1") inch, providing an eighth (⅛") inch wall thickness, so that the connector body 13 will be reliable and strong.

All in all, with the exemplary connector system of the invention, there will be a sure and reliable connection that generally will not corrode, rust or fall off the end of the pipe. With this connector there is only three parts, a basic body and two, simple, off-the-shelf lugs or set screws, to worry about—instead of many, relatively complex parts as in the prior art, and the connector system of the invention provides an easy and quick installation even in tight quarters, that is, even in close distances from walls, studs and many odd places that might otherwise be hard to get to.

Although the embodiment described above, is currently the most preferred, the basic body 13 could be made with a square or rectangular or other cross-section configuration (rather than being generally cylindrical), supplemental lugs could be added to the two illustrated, the outer diameters of the pipe section and the wire sections could be made coextensive, i.e., have the same outer diameters or the two sections could be blended together, i.e., the larger, outer surface of the pipe section could be angled down to meet with the smaller, outer surface of the wire section forming an exterior, somewhat conical-section shape, the inner chamber in the wire section could be off-set to, for example, one side (rather than being concentric), the interior chamber of one section could be isolated from the other interior chamber (i.e., not be in open communication with the other), etc. These, of course, are only some, exemplary changes that could be made in the connector body 13. Likewise, the set screw lugs could be of a different design and have exterior, slotted heads for being driven by a screw driver, etc. Also, although cylindrically shaped grounding members in the form of hollow pipes or conduits or solid rods are the most common, the connector body 13 could be used with grounding members having square or rectangular or other polygonally shaped grounding members. It should be noted that, within the context of this patent application, the terms "pipe" and "conduit" are considered equivalent terms.

It is noted that the embodiment(s) described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

I claim:

1. A connector for electrically and mechanically connecting a ground wire having an outer surface to an elongated grounding member, such as a grounding pipe or rod in the ground or electrical conduit, having an exposed end and an outer, exterior surface, comprising:

a connector body of electrically conductive material positionable over the exposed end of the grounding member and including a larger, grounding member section having a first, open, interior chamber defined by a first surrounding, inner wall, which is larger in its interior dimensions than the outer dimensions of the grounding member, allowing the connector body to be slipped over the end of the elongated grounding member; and a smaller, wire section adjacent to said grounding member section having a second, open, interior chamber defined by a second, surrounding, inner wall for the interior insertion of the wire, said body having at least in part a ridge area having smaller interior dimensions than said first inner wall, forming a laterally directed, interior blocking area, said interior dimensions of said ridge area being less than the outer dimensions of the grounding member, preventing the ground wire and the grounding member from passing one another due to the presence of said ridge area; said sections being generally cylindrical with cylindrical interiors, with the inner diameter and the outer diameter of said wire section being less than the inner diameter and outer diameter, respective, of said grounding section;

a first, laterally directed, set screw lug having an interior tip for the grounding member being screwable laterally into said first interior chamber until it contacts and drives itself down against the outer surface of the grounding member, holding the grounding member under compression between its interior tip and said interior wall of said first, interior chamber; and a second, laterally directed, set screw lug having an interior tip for the ground wire being screwable laterally into said second chamber until it contacts and drives itself down against the outer surface of the ground wire located in said second, interior chamber, holding it under compression between its interior tip and said interior wall of said second, interior chamber; the connector body electrically connecting and mechanically securing the ground wire to the grounding member.

2. The connector of claim 1, wherein:

said two chambers are cylindrical and coaxial with each other and in open communication with each other.

3. The connector of claim 1, wherein:

said interior ridge area of the connector body provides face-to-face contact with the end of the grounding member.

4. The connector of claim 1, wherein:

said first and second set screw lugs each have a driving end located on the exterior of said connector body with each driving end having a driving orifice in it for the insertion of a driving tool.

5. The connector of claim 1, wherein:

said first and second set screw lugs are located with one end of each exposed on the exterior of said connector body and being located along the same longitudinal line.

6. The connector of claim 1, wherein:

said first and second set screw lugs are made of electrically conductive material.

7. The connector of claim 1, wherein said connector consists of:

said connector body and said lugs, with said connector body being a single, integral, unitary part.

8. The connector of claim 7, wherein:

said connector body is made of a single casting of brass alloy.

9. A system for electrically and mechanically connecting a ground wire having an outer surface to an elongated grounding member, such as a grounding pipe or rod in the ground or in an electrical conduit, having an exposed end and an outer, exterior surface, comprising:

a generally cylindrical, connector body of electrically conductive material positioned over the exposed end of the grounding member and having a larger, generally cylindrical, pipe section with an inner diameter forming a first, open, interior chamber defined by a first encircling, inner wall, which is larger in its inner diameter than the outer diameter of the grounding member, allowing the connector body to be slipped over the end of the elongated grounding member; and a smaller, generally cylindrical, wire section having an inner diameter forming a second, open, interior chamber defined by a second, encircling, inner wall, which at least in part has a smaller inner diameter than said first inner wall but is coaxial with said first encircling inner wall and is in open communication therewith, forming a flat, laterally directed ridge between said inner walls, said inner diameter of said wire section being less than the outer diameter of the grounding member, preventing the two from passing one another due to the presence of said ridge, said interior ridge of the connector body being in face-to-face contact with the end of the grounding member;

a first, axially directed, set screw lug of electrically conductive material having an interior tip for the grounding member being screwable axially down until it contacts and drives itself down against the outer surface of the grounding member, holding it under compression between its interior tip and the interior surface of said first, interior chamber; and a second, axially directed, set screw lug of electrically conductive material having an interior tip for the ground wire being screwable axially down until it contacts and drives itself down against the outer surface of the ground wire located in said second, interior chamber, holding it under compression between its interior tip and the interior wall of said second, interior chamber, said first and second set screw lugs having driving ends located on the exterior of said connector body and being located along the same longitudinal line and having driving orifices in them for the insertion of a driving tool.

10. The connector system of claim 9, wherein said connector system consists of:

said connector body and said lugs, with said connector body being a single, integral, unitary part.

11. The connector system of claim 10, wherein:

said connector body is made of a single casting of brass alloy.

12. A method of electrically and mechanically connecting a ground wire having an outer surface to an elongated grounding member, such as a grounding pipe or rod in the ground or in an electrical conduit, having an exposed end and an outer, exterior surface, comprising the steps of:

a) using a connector body of electrically conductive material positionable over the exposed end of the grounding member and including a larger, grounding member section having a first, open, interior chamber defined by a first surrounding, inner wall, which is larger in its interior dimensions than the outer dimensions of the grounding member, allowing the connector body to be slipped over the end of the elongated grounding member; and a smaller, wire section adjacent to said grounding member section having a second, open, interior chamber defined by a second, surrounding, inner wall for the interior insertion of the wire, said body having at least in part a ridge area having smaller interior dimensions than said first inner wall, forming a laterally directed, interior blocking area, said interior dimension of said ridge area being less than the outer dimensions of the grounding member, preventing the two from passing one another due to the presence of said ridge area;

a first, laterally directed, set screw lug having an interior tip for the grounding member being screwable laterally into said first interior chamber; and a second, laterally directed, set screw lug having an interior tip for the ground wire being screwable laterally into said second chamber;

b) placing said connector body over the end of the grounding member with said first chamber fitting and covering over the end of the grounding member and screwing down said first set screw lug until it contacts and drives itself down against the outer surface of the grounding member, holding the grounding member under compression between its interior tip and said interior wall of said first, interior chamber; and c) inserting the ground wire into the interior of at least said second chamber and screwing down said second set screw lug until it contacts and drives itself down against the outer surface of the ground wire, thereby causing said second set screw lug to hold the wire under compression between its interior tip and said interior wall of said second, interior chamber; thereby using said connector body to electrically connect and mechanically secure the ground wire to the grounding member through the two interiorly contained, compressive contacts with them created by said lugs.

13. The method of claim 12, wherein step "b" includes the further step of:

pushing the connector body over the exposed end of the grounding member until said ridge area contacts the end of the member in fact-to-face contact, allowing the ridge member to rest on the end of the member.

14. The method of claim 12, wherein said two chambers are in open communication with each other and step "c" includes the further step of:

inserting the ground wire into the connector body until it extends at least into the interior of said first chamber.

15. The method of claim 12, wherein said first and second set screw lugs each have a driving end located on the exterior of said connector body with each driving end having a driving orifice in it for the insertion of a driving tool and steps "b" and "c" each includes the further step of:

inserting the driving tool into the driving orifice and using it to drive its respective lug.

* * * * *